United States Patent [19]

Rostron

[11] 4,273,978

[45] Jun. 16, 1981

[54] LIQUID INTERRUPTER MODULE

[75] Inventor: Joseph R. Rostron, Murrysville, Pa.

[73] Assignee: Electric Power Research Institute, Inc., Palo Alto, Calif.

[21] Appl. No.: 914,026

[22] Filed: Jun. 9, 1978

[51] Int. Cl.[3] ..... H01H 33/82

[52] U.S. Cl. ..... 200/148 R; 200/148 A; 200/148 E; 200/150 G

[58] Field of Search ..... 200/145, 147 R, 148 R, 200/148 B, 148 A, 148 G, 148 E, 148 C, 150 R, 150 B, 150 G

[56] References Cited

U.S. PATENT DOCUMENTS

| | | | |
|---|---|---|---|
| 3,099,724 | 7/1963 | Silliman et al. | 200/148 B X |
| 3,110,791 | 11/1963 | Aspey et al. | 200/150 B X |
| 3,150,245 | 9/1964 | Leeds et al. | 200/150 B X |
| 3,180,959 | 4/1965 | MacNeill et al. | 200/145 |
| 3,214,541 | 10/1965 | Baker et al. | 200/148 R X |
| 3,257,533 | 6/1966 | Leeds | 200/148 B |
| 3,259,724 | 7/1966 | Aspey et al. | 200/148 R |
| 3,291,949 | 12/1966 | Cromer | 200/148 C |
| 3,406,269 | 10/1968 | Fischer | 200/148 G |
| 3,531,609 | 9/1970 | Gratzmuller | 200/150 G |
| 3,569,651 | 3/1971 | Gratzmuller | 200/148 G |
| 3,842,227 | 10/1974 | Gratzmuller | 200/148 G X |
| 3,988,554 | 10/1976 | Graf et al. | 200/150 G X |
| 4,034,175 | 7/1977 | Gratzmuller | 200/150 B X |

*Primary Examiner*—James R. Scott

*Attorney, Agent, or Firm*—Flehr, Hohbach, Test, Albritton & Herbert

[57] ABSTRACT

The invention provides a current interrupter employing a liquified dielectric medium such as sulfur hexafluoride to effect rapid arc extinction. A pump cylinder forces the dielectric liquid into the vicinity of a fixed contact. The pump cylinder is refilled from within the contact enclosure after each current interruption to allow for repeated operations. Check valves are provided for preventing any dielectric gas from entering the pump cylinder. The interrupter system further includes a pressure absorbing accumulator for smoothing pressure changes and a cooler for removing heat from the dielectric medium.

14 Claims, 5 Drawing Figures

LIQUID INTERRUPTER MODULE

BACKGROUND OF THE INVENTION

The present invention is directed to a current interrupter of the type employing a dielectric liquid supplied to the vicinity of arcing contacts upon opening to extinguish the arc.

In U.S. patent application Ser. No. 818,004, filed July 22, 1977, now abandoned and assigned to the assignee of the present application, there is described an interrupter system which employs a dielectric liquid such as sulfur hexafluoride ($SF_6$) to extinguish the arc between the contacts. That application describes an apparatus which forces the dielectric liquid through a nozzle. Where liquid $SF_6$ is used, the excellent dielectric properties of the relatively high-density liquid, and the like pressures generated in the arcing region allow for interruption of currents exceeding 100,000 amperes. The interrupter of application Ser. No. 818,004 includes an accumulator system for smoothing the pressure variations encountered in the interrupter during high current interruptions. The approach described allows for high pressures in the arcing region while eliminating the complex pressure maintaining systems used in the prior art, such as are described in Leeds et al, U.S. Pat. No. 3,150,245. Another interrupter in which a dielectric liquid is forced through a nozzle in the arcing region is described in U.S. patent application Ser. No. 826,382, filed Aug. 22, 1977, now abandoned and assigned to the assignee of the present application.

In interrupters which use a pump piston moving in a cylinder to drive the dielectric fluid into the arcing region, the pump cylinder must be refilled after the piston has been returned to its starting position to allow for subsequent interruptions. Use of external pressure reservoirs for refilling the pump cylinder with dielectric liquid is undesirable for several reasons. First, a liquid dielectric is relatively incompressible and the pressure developed in a pressurized reservoir will drop rapidly as the liquid exits the reservoir. Consequently, mechanical pumping or suitable adjacent gas reservoirs are required to maintain pressure. Second, the sliding seals, valves, and connections associated with a high-pressure reservoir are susceptible to leaks. Furthermore, any system employing a pressure differential using liquid $SF_6$ presents the problem of freezing of the dielectric fluid as it is dumped into a region of lower pressure.

In one prior art patent, Fisher, U.S. Pat. No. 3,406,269, an interrupter is disclosed (in FIG. 5) in which arcing contacts are immersed in liquid $SF_6$ and a separate pressure reservoir is not used. Fisher suggests, however, that the interior pressure of the interrupter be maintained at 2,000 p.s.i., which presents severe leakage problems requiring high cost construction techniques. The Fisher interrupter would be unable to successfully interrupt very large currents (100,000+ amperes) at lower interior pressures.

OBJECTS AND SUMMARY OF THE INVENTION

It is a general object of the present invention to provide an improved current interrupter which employs a dielectric liquid to effectively interrupt large currents.

Another object of the invention is to provide an improved current interrupter which provides for repeated opening and reclosing operations.

Another object of the invention is to provide an interrupter having a system for refilling a liquid pumping cylinder without the use of an external pressurized reservoir.

Another object of the invention is to provide an interrupter having a readily maintainable interior pressure and which employs a dielectric liquid for arc extinction.

Accordingly, a current interrupter is provided comprising an enclosure for holding a dielectric medium under temperature and pressure conditions which provide for a dielectric liquid below a predetermined level of dielectric liquid in the enclosure and a dielectric gas above the dielectric liquid. A fixed contact and a movable contact are provided in the enclosure. The movable contact is movable into electrical contact with the fixed contact. A cylinder opens into the enclosure and a pump piston is supported for movement in the cylinder. A flow passageway extends from the cylinder opening to the fixed contact. A first check valve is provided in the fluid passageway for permitting unidirectional fluid to flow from the cylinder to the fixed contact. Refill passage means permit fluid to enter the cylinder from a point inside the enclosure and below the level of dielectric liquid. Means are provided for moving the pump piston and the movable contact to separate and reclose the contacts and drive the pump piston in the cylinder. The piston forces fluid through the fluid passageway on contact separation and draws fluid into the cylinder by way of the refill passage means upon contact reclosure.

DESCRIPTION OF THE PREFERRED EMBODIMENT

Figure 1:
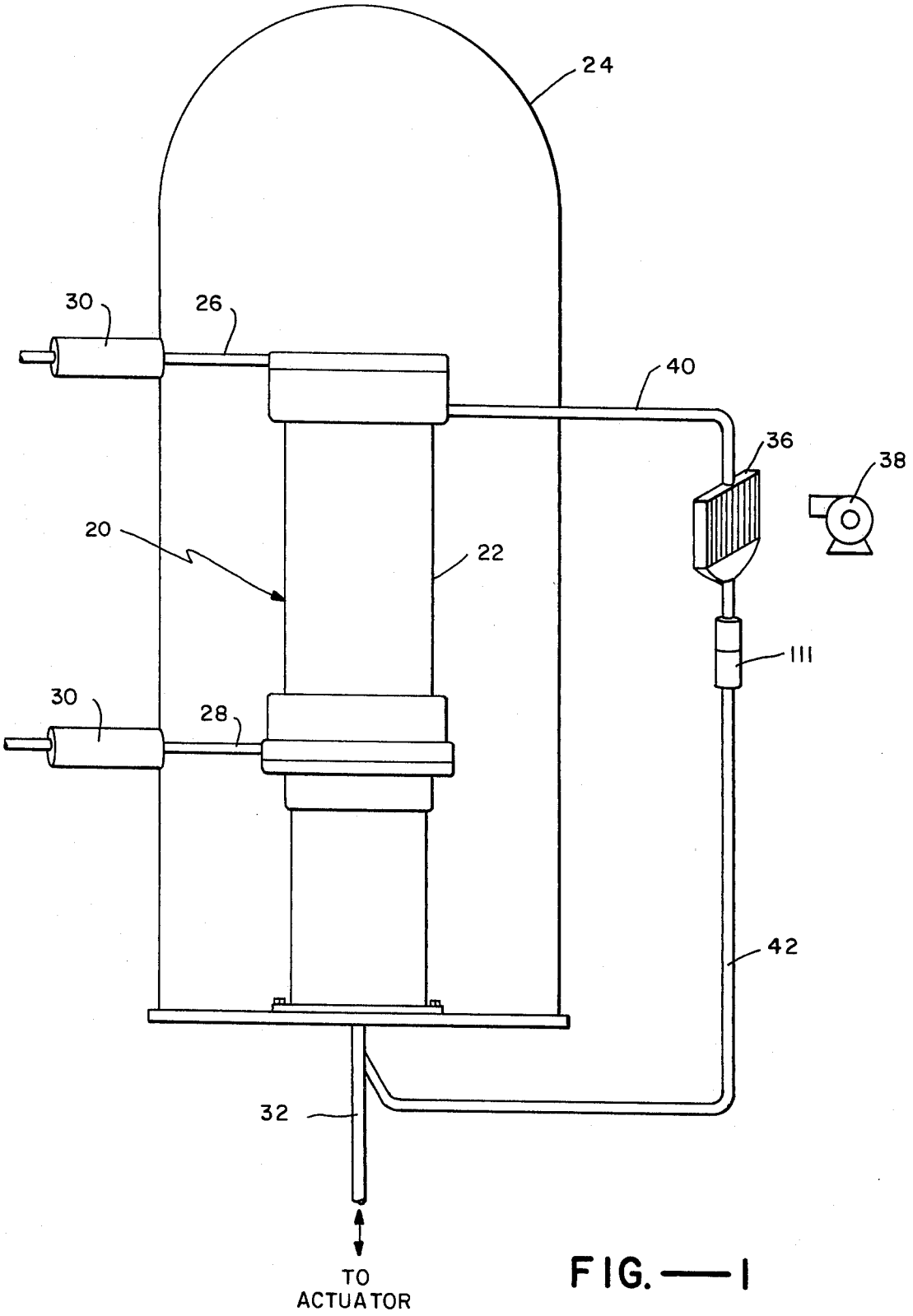
FIG. 1 is a plan view in partial cross-section of a current interrupter according to the present invention.

Referring to FIG. 1, a current interrupter is shown having a housing 20 containing a dielectric medium such as sulfur hexafluoride ($SF_6$) under pressure. Side walls 22 of housing 20 are formed of a suitable strong insulating material such as ceramic. Housing 20 is supported within a grounded metal tank 24 which is preferably filled with a relatively low pressure dielectric gas such as $SF_6$ gas at approximately 50 p.s.i. Extending through the side of tank 24 are a pair of buses 26 and 28 enclosed in outwardly-extending metal sheaths 30. A movable actuating rod 32 extends out the bottom of housing 20 and tank 24. Rod 32 passes through a suitable sliding seal 34 (see FIG. 2) which prevents the escape of the pressurized medium within the housing.

To the side of tank 24 is a cooling means 36 for cooling the pressurized dielectric medium in housing 20. Cooler 36 can be any suitable heat-dissipating structure such as a finned radiator. Additional cooling capacity is provided by a fan 38. An outflow tube 40 extending from housing 20 through tank 24 to cooling means 36 supplies dielectric medium to the cooling means. An inflow tube 42 extending through the bottom of housing 20 returns cooled dielectric medium to the housing from cooler 36.

Figure 2:
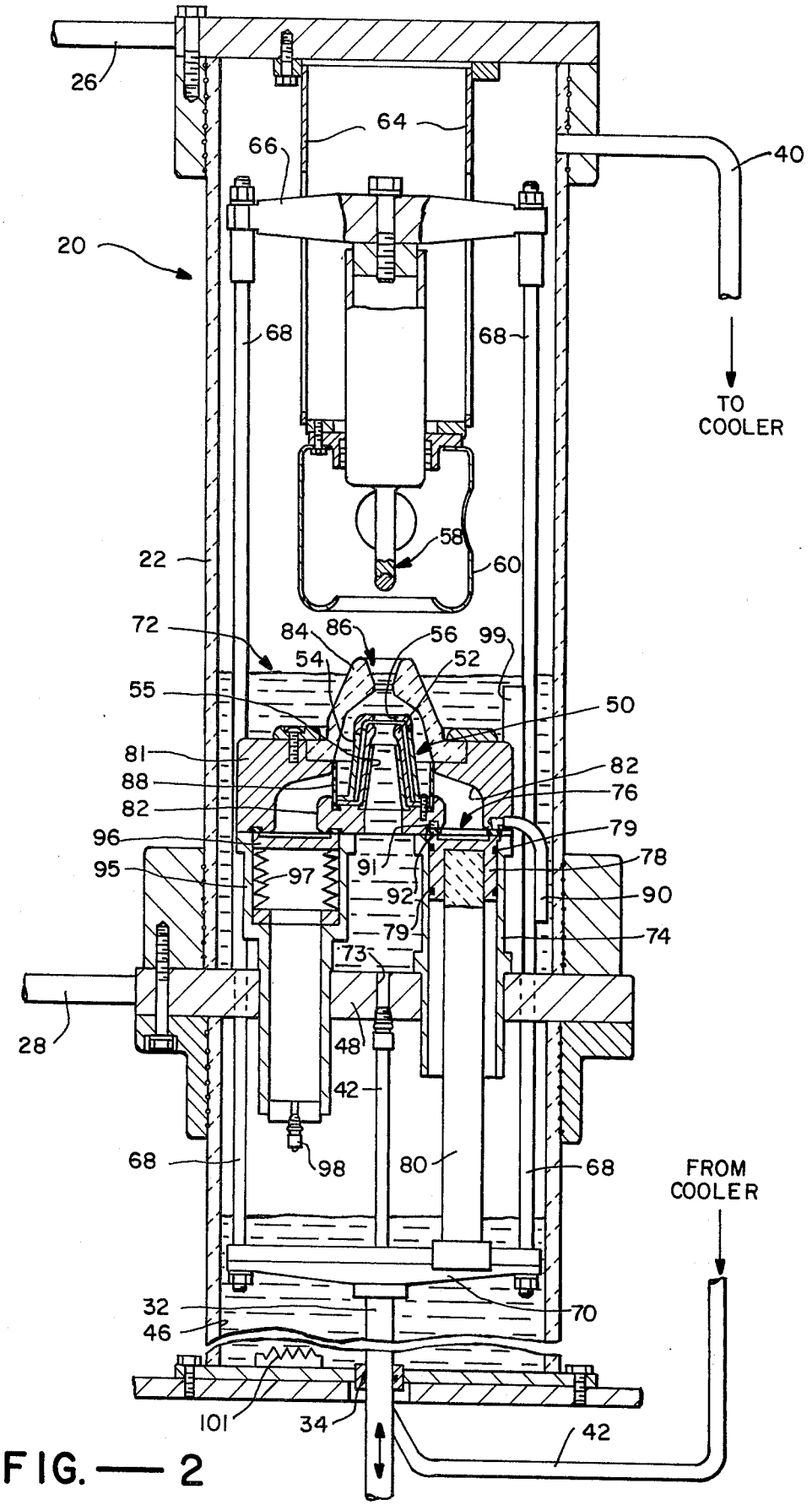
FIG. 2 is a partial cross-sectional view of the housing portion of the interrupter shown in FIG. 1.
Figure 3:
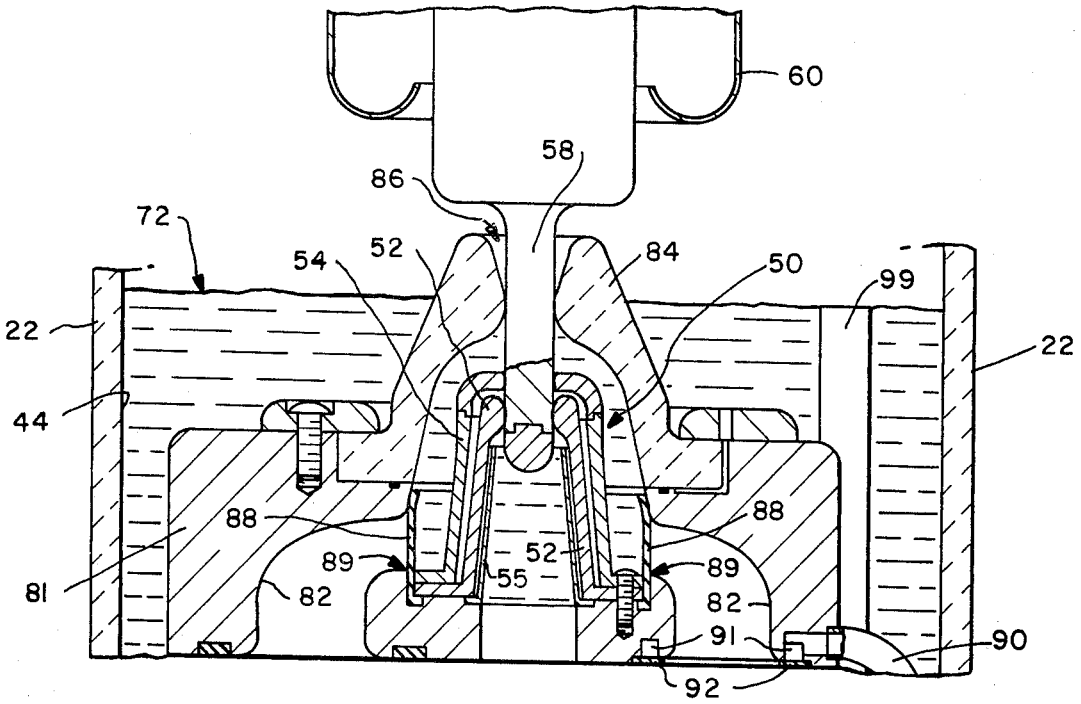
FIG. 3 is a partial cross-sectional view of the contacts shown in FIG. 2 with the interrupter contacts closed.

Referring to FIG. 2, housing 20 is divided into two separate chambers 44 and 46 separated by a dividing wall 48. The upper chamber 44 is the enclosure for the interrupter contacts and will be referred to below as enclosure 44. A lower chamber 46 serves as a holding reservoir for dielectric liquid, as is described more fully below. Supported in enclosure 44 on dividing wall 48 is an electrically conductive block 81 on which is mounted a fixed contact assembly 50. The fixed contact assembly includes a plurality of metal fingers 52 enclosed within a metal cap 54. Fingers 52 extend around a tapered metal nozzle 55, which opens downwardly below the contact assembly 50. Contact assembly 50 will be referred to below as fixed contact 50. An opening 56 in the top of cap 54 admits a downwardly-extending movable contact 58. The movable contact 58 is movable into electrical contact with fixed contact 50. When the contacts are closed, as illustrated in FIG. 3, fingers 52 engage portion 58 to provide a path for current flow.

An enclosing metal voltage shield 60 is supported in enclosure 44 by a guide assembly 64 extending from the top of the housing. Movable contact 58 retracts into shield 60 when in the open position, as shown in FIG. 2. Movable contact 58 is supported in enclosure 44 by cross bar 66. Electrical contacts (not shown) on guide assembly 64 electrically connect cross bar 66 with bus 26. Motion is imparted to cross bar 66 by a pair of actuating rods 68 formed of an insulating material such as glass epoxy. The actuating rods 68 extend through sliding seals (not shown) in housing wall 48 into lower chamber 46, where they are attached to a second cross bar 70. Motion is imparted to cross bar 70 from actuating means exterior of housing 20 by way of rod 32. The fixed contact is electrically interconnected with lower bus 28 through dividing wall 48.

Enclosure 44 holds a dielectric medium, preferably $SF_6$, under pressure sufficient to liquefy the medium at normally-encountered ambient temperatures. At a temperature of 70° F., the pressure within housing 44 is preferably approximately 300 p.s.i. The $SF_6$ will form a liquid in the bottom of the enclosure below a predetermined level 72. Given a sufficient charge of $SF_6$ in housing 20, the surface of liquid $SF_6$ will not fall significantly below level 72 at any normally-encountered ambient temperatures. The $SF_6$ above level 72 is gaseous. Fixed contact 50 is preferably disposed below liquid level 72 so as to always be immersed in liquid $SF_6$. The outflow tube 40 to cooler 36 extends into enclosure 44 above liquid level 72 and the inflow tube 42 from the cooler connects to an opening 73 in dividing wall 48 below level 72.

To efficiently employ the excellent dielectric properties of liquid $SF_6$, means are provided in the lower part of enclosure 44 for pumping and directing the liquid into the arcing region of the interrupter. One such means is a pump cylinder 74, extending through wall 48 and opening at 76, within enclosure 44. A pump piston 78 is supported for movement in cylinder 74. Piston 78 includes suitable seals 79 to prevent escape of fluid from enclosure 44. An insulating actuating rod 80 coupled to lower cross bar 70 in lower chamber 46 serves to move piston 78 in the cylinder. An annular flow passageway 82 is formed within an electrically conductive block 81 supporting fixed contact 50. Flow passageway 82 extends from cylinder opening 76 around fixed contact 50. Passageway 82 directs fluid from cylinder 74 to the vicinity of the fixed contact. Enclosing the upper end of the fixed contact is a fluid-flow nozzle 84 having a nozzle opening 86 directly over opening 56 in contact cap 54. Nozzle 84 is preferably formed of an insulating material such as TEFLON (Trademark). Flow passageway 82 delivers fluid directly into nozzle 84 to provide a continuous fluid flow path around the fixed electrode and into the principal arcing region of the interrupter.

Extending around fixed contact 50 in flow passageway 82 is a first check valve 88 for permitting unidirectional fluid flow from cylinder 74 to the fixed contact. Valve 88 is a form of flap valve comprising a substantially cylindrical resilient member extending between opposite walls of passageway 82. The resilient member 88 is fixed to one wall of the passageway, at 89 (see FIG. 3). Valve 88 folds over toward fixed contact 50 to admit fluid into the immediate vicinity of the fixed contact, as is shown most clearly in FIG. 4. If fluid attempts to pass the other way toward cylinder 74 in the passageway, valve 88 straightens to extend between the passageway walls, blocking fluid flow. Any suitable resilient material can be used for valve 88, for example neoprene or ethylene propylene.

Extending out the side of support block 81 adjacent pump cylinder 74 is a refill passage tube 90. The refill passage communicates with an annular channel 91 formed in block 81 around cylinder opening 76. All the fluid entering cylinder 74 by way of passage 90 passes through annular channel 91. Loosely positioned adjacent channel 91 is a ring-shaped member 92 which serves to cover and block the annular channel to prevent fluid from passing into the annular channel from the cylinder. Because ring 92 is not fixed in position, it will drop down to permit fluid to pass into the pump cylinder from the annular channel. As such, ring 92 serves as a second check valve in the interrupter for permitting unidirectional fluid flow. The valve prevents fluid flow from cylinder 74 into the remainder of enclosure 44 through passage 90. Refill passage tube 90 extends outside the pump cylinder to a point inside the enclosure and below liquid level 72. Therefore, as the pump piston 78 is drawn downwardly in cylinder 74, the pump cylinder refills only with dielectric liquid and not with any gas from the top of enclosure 44.

Opposite the pump cylinder 74 in enclosure 44 is a substantially parallel gas-filled cylinder 95 in which a floating piston 96 is supported for movement. Cylinder 95 communicates with flow passageway 82 and serves as a pressure-absorbing device similar to the accumulator described in U.S. Patent Application Ser. No. 818,004, filed July 22, 1977, now abandoned, assigned to the assignee of the present application. The cylinder 95 contains a highly pressurized gas such as nitrogen at a pressure of approximately 2,000 p.s.i. In the upper portion of cylinder 95 beneath piston 96 the gas is preferably contained within a welded metal bellows 97. The bellows permit downward movement of piston 96 while preventing escape of any of the highly pressurized gas. In the preferred embodiment cylinder 95 extends through housing wall 48 into lower chamber 46 and includes a gas injection valve 98 at the lower end for filling the cylinder.

An overflow conduit 99 opening at the level of dielectric liquid 72 inside enclosure 44 serves to keep the liquid level substantially constant. The overflow conduit extends from enclosure 44 into the lower chamber 46 within housing 20. Chamber 46 is a holding reservoir providing a reserve supply of dielectric medium for the interrupter. To allow overflow conduit 99 to function properly, the holding reservoir should be outside contact enclosure 44 disposed below liquid level 72. Because overflow conduit 99 is open between the two chambers of housing 20, the lower chamber 46 is pressurized to the same degree as the contact enclosure 44. Generally, the holding reservoir will contain some dielectric in liquid form and some in gaseous form. A small heating element 101 in the holding reservoir will serve to boil off some of the dielectric liquid, causing the resultant gas to rise into the contact enclosure 44 through the overflow conduit. Heater 101 can be powered by a conventional auxiliary power source (not shown). Such auxiliary power supplies generally are provided in power substations and similar installations for powering equipment. The heater serves to maintain the level of liquid in enclosure 44 when ambient temperatures might otherwise cause the liquid level to drop below the level of the opening of overflow conduit 99. When using $SF_6$ as a dielectric medium, with housing 20 pressurized to approximately 300 p.s.i., a suitable value for the output of heater 101 would be 200 watts.

Besides serving as a holding reservoir, lower chamber 46 of housing 20 encloses the mechanical linkages for operating the interrupter. Parts of actuating rod 32, cross bar 70, and actuating rods 68 and 80 are housed within lower chamber 46. The dielectric inflow tube 42 from external cooler 38 (see FIG. 1) preferably passes through chamber 46 to connect to opening 73.

Coupled to the outer end of rod 32 is a suitable actuating apparatus (not shown) for imparting motion to rod 32. As noted above, rod 32 not only serves as the movable means for separating and reclosing the contacts but also moves pump piston 78 in the pump cylinder. The actuator coupled to rod 32 must be capable of separating the interrupter contacts rapidly, within several milliseconds. Moreover, the actuator must be relatively powerful to rapidly drive piston 78 against the dielectric liquid in cylinder 74 and flow passageway 82.

Figure 4:
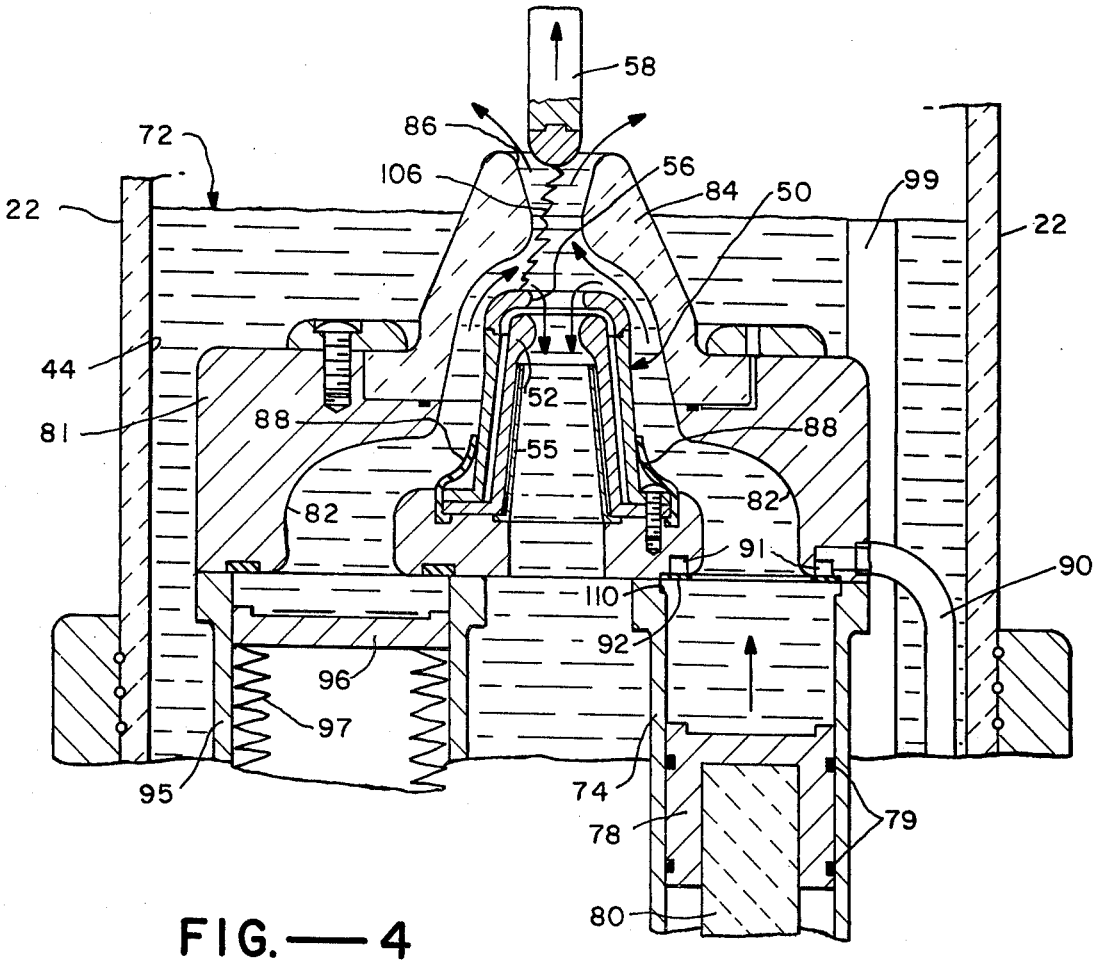
FIG. 4 is a partial cross-sectional view of the contacts and liquid dielectric pumping system shown in FIG. 2 during contact opening.
Figure 5:
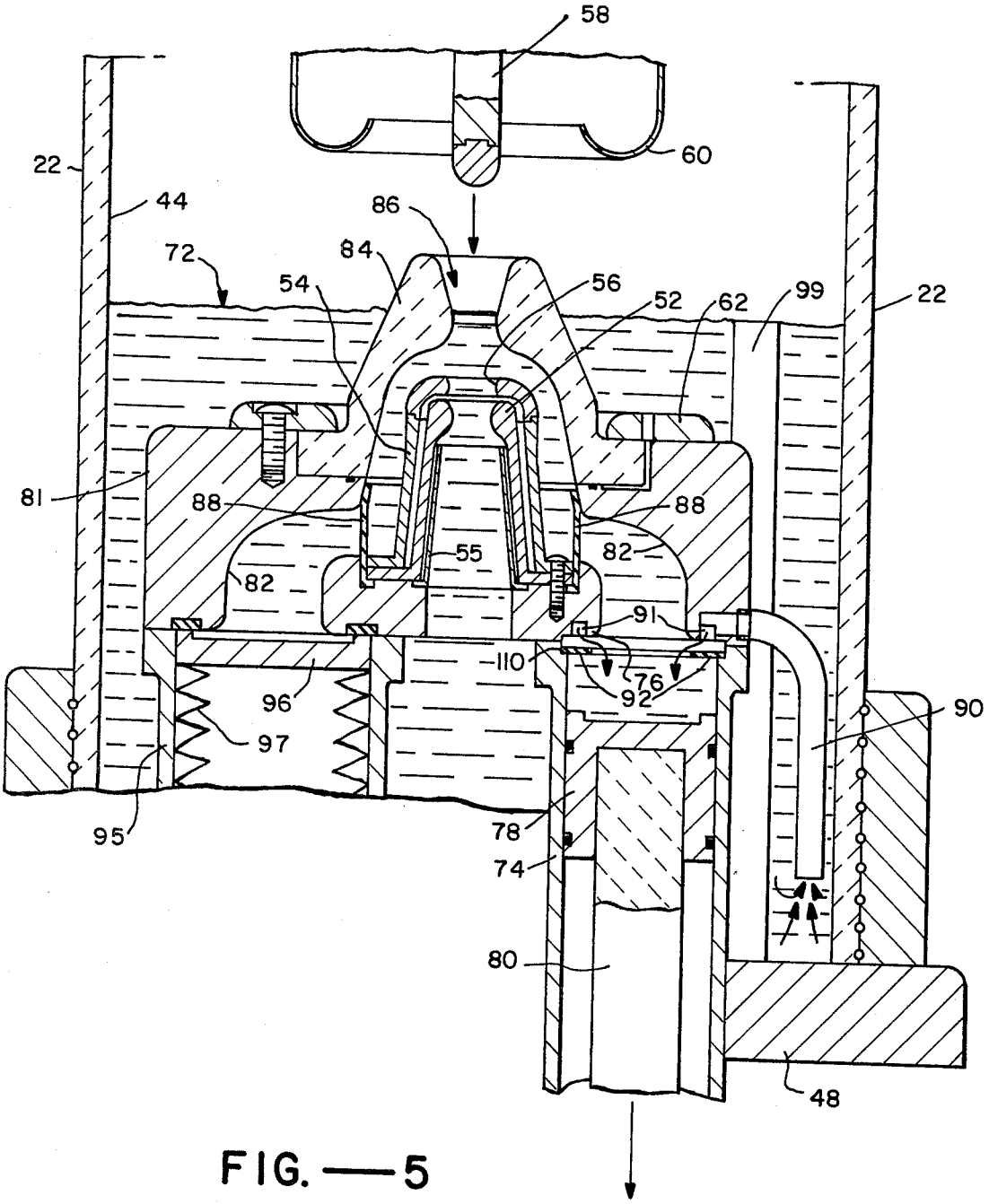
FIG. 5 is a cross-sectional view as in FIG. 4 showing contact reclosure.

Operation of the interrupter of the present invention is illustrated in FIGS. 3–5. The normal current-carrying mode of the interrupter is shown in FIG. 3. The upper movable contact is in its closed position with the downwardly-extending contact portion 58 extending into opening 86 of nozzle 84 and opening 56 of cap 54. Fingers 52 engage contact 58. Current is carried through the contacts between external bus connections 26 and 28. When the contacts are closed, pump piston 78 is withdrawn into cylinder 74, which is filled with dielectric liquid ($SF_6$).

An external fault detection system (not shown) monitors the circuit conditions. If circuit isolation is called for, a signal is sent to the previously-mentioned actuator coupled to rod 32 to open the contacts. Upon receipt of an "open" signal, the actuator moves rod 32 upwardly, separating movable contact 58 from the fixed contact and simultaneously driving pump piston 78 upwardly in cylinder 74. When the contacts separate, an arc 106 is developed which extends through opening 86 of nozzle 84. As is well known in the interrupter art, the arc continues to carry substantially the full fault current until extinguished.

As the contacts are separating, pump piston 78 moves upwardly in cylinder 74, forcing dielectric liquid through flow passageway 82 into the vicinity of fixed contact 50. The flow of dielectric liquid collapses check valve 88, as shown in FIG. 4. Ring 92 prevents escape of the liquid $SF_6$ through refill passage 90. The dielectric liquid is forced out through nozzle opening 86, increasing the voltage drop of arc 106. The nozzle restricts the flow path causing a large increase in fluid pressure around contact 50. The ion stream of arc 106 partially clogs nozzle opening 86, further restricting fluid flow and greatly increasing the pressure of the liquid $SF_6$ as it is compressed by piston 78. The pressure and dielectric properties of the liquid $SF_6$ produce a high arc voltage.

When a current zero is reached in the alternating current cycle, the arc disappears. If sufficient dielectric strength exists between the electrodes, re-ignition is prevented. In interrupters of this type, the current will pass through one or two current zeroes (half-cycles) before are re-ignition is prevented. Assuming a 60 hertz alternating current, approximately three cycles will elapse between initial fault current detection and full contact separation. During the time in which the movable contact is moving, pump cylinder 78 continues to force dielectric liquid through flow passageway 82 and out nozzle opening 86. This insures a sufficient supply of the dielectric liquid to extinguish the arc.

To prevent excessive pressure levels within passageway 82 and nozzle 84, piston 96 moves downwardly in pressure-absorbing cylinder 95. Cylinder 95 and piston 96 function in the same manner as the accumulator described in abandoned application Ser. No. 818,004. As the pressure in passageway 82 increases, piston 96 moves downwardly, compressing bellows 97 and the gas within to prevent the pressure in passageway 82 from becoming excessive. As a current zero approaches in the alternating current cycle, the arc becomes smaller, permitting more of the dielectric liquid and generated gases to escape through nozzle opening 86. At this point accumulator piston 96 is moved upwardly in cylinder 95 by the high pressure gas within. This upward movement of the piston helps to maintain high pressure levels within passageway 82. Cylinder 95 and piston 96 thus serve to smooth the pressure variations which occur in the fluid passageway of the interrupter.

To reclose the contacts, a signal is sent to the previously mentioned actuator to move rod 32 downwardly. As shown in FIG. 4, movable contact 58 and pump piston 78 descend together. Dielectric liquid is drawn into cylinder 74 by pump piston 78 through refill passage tube 90. Valve ring 92 drops down onto a shoulder 110 in cylinder 74 to admit fluid through channel 91. Because the dielectric liquid is drawn from near the bottom of enclosure 44 through a downwardly-extending tube, no gaseous $SF_6$ enters the pump cylinder. Preventing gas from entering cylinder 74 is important to insure that maximum pressures are generated by the next upward stroke of pump piston 78. Check valve 88 in fluid passageway 82 prevents any $SF_6$ from entering pump cylinder 74 through flow passageway 82.

The interrupter contacts can be opened and reclosed repeatedly. Often the contacts must be opened several times to protect against a fault and the present invention is particularly adapted to such operations. There is no external supply of dielectric medium to be exhausted.

Throughout the operation of the interrupter, both during normal current carrying and interruptions, external cooler 36 continues to function. As heat is generated by the current carrying contacts and also by heater 101, dielectric gas is evaporated and rises to the top of the housing. The gas then enters outflow conduit 40 and is cooled by cooler 36, where it condenses to a liquid.

The cooler is preferably positioned above liquid level 72 of the interrupter so the liquid will be returned by gravity to the enclosure via inflow tube 42. To allow for external monitoring of the liquid level in the contact enclosure, a suitable sight glass apparatus 111 is included on inflow tube 42, if desired. The pressure within tubes 40 and 42 and cooler 36 is the same as within housing 20. Cooler 36 preferably has a cooling capacity sufficient to remove approximately 2,000 watts of heat from the dielectric medium to maintain the $SF_6$ in a liquid state.

The interrupter of the present invention effectively interrupts currents on high voltage (e.g., 145 Kv) lines in excess of 100,000 amperes without use of an external shunt capacitance and/or resistance. Multiple openings and reclosings are provided for. The excellent dielectric properties of liquid $SF_6$ are employed without the need for an exterior pressurized supply to refill the pump. The $SF_6$ is at a readily achieved and easily maintained pressure, minimizing construction costs since high pressure construction techniques are not required for housing 20. Very high pressure liquid $SF_6$ is employed only in the immediate vicinity of the arcing contacts and only for limited times. Thus, the system has a high degree of reliability. During normal operation the contacts operate immersed in liquid $SF_6$ which serves to keep them cool, increasing their current-carrying capacity. The external cooling system and internal heater use relatively little power and can be of conventional and very rugged construction.

Alternative embodiments are possible within the scope of the invention. Alternative types of liquid pumps could be employed, for example. An alternative type of pressure-absorbing accumulator could be used. A dielectric medium other than $SF_6$ could be employed, such as selenium hexafluoride ($SeF_6$) or another effective dielectric which can be readily liquified.

An improved current interrupter has been described which employs a dielectric liquid to effectively interrupt large currents. The interrupter provides for repeated contact openings and reclosings. The interrupter includes a system for refilling the dielectric liquid pumping cylinder without the use of an external pressurized reservoir. The interrupter employs a very highly pressurized dielectric liquid for effective arc extinction while maintaining the entire charge of dielectric medium at readily achievable pressures when the contacts are closed.

What is claimed is:

1. A current interrupter comprising: an enclosure, a fixed contact in said enclosure, a movable contact in said enclosure, said movable contact being movable into electrical contact with said fixed contact, a dielectric located within said enclosure wherein the temperature and pressure conditions are such that said dielectric exists in a gaseous form in the upper part of said enclosure and in a liquid form in the lower part of said enclosure, a boundary being defined between the gaseous form and liquid form of said dielectric, a cylinder positioned in the lower part of said enclosure to be below the boundary defined by the gaseous form and liquid form of said dielectric, a pump piston supported movement in said cylinder, a flow passageway extending from an opening of said cylinder to said fixed contact to establish fluid communication therebetween for the flow of the liquid form of said dielectric into the vicinity of said fixed contact, a first check valve in said flow passageway for permitting unidirectional flow from said cylinder to said fixed contact, a refill passage in said enclosure for establishing fluid communication between said cylinder and the liquid form of said dielectric for refilling said cylinder with the dielectric liquid, and means for moving said pump piston and said movable contact to separate and reclose said contacts and to drive said pump piston in said cylinder, said pump piston forcing the liquid form of said dielectric through said flow passageway upon contact separation and drawing the liquid form of said dielectric into said cylinder by way of said refill passage upon contact reclosure.

2. A current interrupter as in claim 1 including cooling means exterior of said enclosure for cooling the dielectric medium in said enclosure, an outflow tube extending into said enclosure above said level of dielectric liquid for supplying dielectric gas to said cooling means, and an inflow tube extending into said enclosure below said level of dielectric liquid for returning cooled dielectric medium to said enclosure.

3. A current interrupter as in claim 2 in which said cooling means exterior of said enclosure is elevated above said level of dielectric liquid in said enclosure.

4. A current interrupter as in claim 1 in which said dielectric medium is sulfur hexafluoride.

5. A current interrupter as in claim 1 in which said flow passageway is annular in shape in the vicinity of said fixed contact and surrounds said fixed contact.

6. A current interrupter as in claim 5 in which said first check valve includes a resilient member surrounding said fixed contact between opposite walls of said flow passageway, said resilient member being attached along only one wall of said flow passageway and folding over toward said fixed contact to admit fluid into the immediate vicinity of said fixed contact.

7. A current interrupter as in claim 1 in which said refill passage includes a second check valve permitting liquid to enter said cylinder and preventing the escape of liquid from said cylinder by way of said refill passage.

8. A current interrupter as in claim 7 in which said refill passage includes an annular channel surrounding said cylinder opening through which dielectric liquid enters said cylinder, said second check valve including a ring-shaped member loosely positioned adjacent said annular channel to admit dielectric liquid into said cylinder and to cover and block said annular channel to prevent dielectric liquid from passing into said annular channel from said cylinder.

9. A current interrupter as in claim 1 in which said flow passageway is in fluid communication with a pressure absorbing means in said enclosure, said pressure absorbing means responsive to pressure changes in said flow passageway as the liquid form of said dielectric flows therethrough for modulating changes in fluid pressure within said flow passageway.

10. A current interrupter as in claim 9 in which said pressure absorbing means includes a floating piston movable in a gas-filled cylinder.

11. A current interrupter as in claim 10 in which said pressure absorbing means further includes metal bellows in said gas-filled cylinder, said metal bellows containing highly pressurized gas.

12. A current interrupter as in claim 1 including a holding reservoir exterior of said enclosure for holding said dielectric under temperature and pressure conditions equal to the temperature and pressure conditions within said enclosure, said holding reservoir being positioned below said enclosure, and an overflow conduit extending between the interior of said enclosure and said holding reservoir to maintain the liquid form of said dielectric in said enclosure.

13. A current interrupter as in claim 12 including heater means in said holding reservoir for vaporizing a portion of the liquid form of said dielectric to its gaseous form so that the gaseous form of said dielectric rises into said enclosure through said overflow conduit.

14. A current interrupter as in claim 1 in which said fixed contact in said enclosure is disposed below the boundary between the gaseous form and the liquid form of said dielectric to be located in the lower part of said enclosure.

* * * * *

UNITED STATES PATENT AND TRADEMARK OFFICE

CERTIFICATE OF CORRECTION

PATENT NO. : 4,273,978

DATED : June 16, 1981

INVENTOR(S) : Joseph R. Rostron

It is certified that error appears in the above-identified patent and that said Letters Patent are hereby corrected as shown below:

Column 1, line 18, between "the," and "pressures" delete "like" and substitute therefor --high--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*